US006312310B1

(12) United States Patent
Sterr et al.

(10) Patent No.: US 6,312,310 B1
(45) Date of Patent: Nov. 6, 2001

(54) KEEPSAKE CONFETTI

(75) Inventors: Ardina K. Sterr, Sherman Oaks; S. Clark Bason, Palm Springs, both of CA (US)

(73) Assignee: Artistry in Motion Entertainment, Inc., Van Nuys, CA (US)

( * ) Notice: Subject to any disclaimer, the term of this patent is extended or adjusted under 35 U.S.C. 154(b) by 0 days.

(21) Appl. No.: 09/416,769

(22) Filed: Oct. 13, 1999

(51) Int. Cl.[7] ..... A63H 37/00
(52) U.S. Cl. ..... 446/475
(58) Field of Search ..... 428/7, 402, 906; 446/34, 475, 491

(56) References Cited

U.S. PATENT DOCUMENTS

| | | | |
|---|---|---|---|
| D. 385,824 | 11/1997 | Sterr et al. . | |
| 825,843 | 7/1906 | Kleimandt . | |
| 1,084,636 | 1/1914 | Hunerkopf . | |
| 1,090,778 | 3/1914 | Clark . | |
| 1,112,241 | 12/1914 | Redington et al. . | |
| 1,491,809 | 4/1924 | Macchia . | |
| 1,663,679 | 3/1928 | Carpenter . | |
| 3,398,614 | 8/1968 | Cleary . | |
| 3,616,720 | 11/1971 | Larson . | |
| 3,677,117 | 7/1972 | Cutter | 83/150 |
| 3,826,170 | 7/1974 | Jones et al. | 83/657 |
| 4,043,234 | 8/1977 | Godin et al. | 83/40 |
| 4,210,041 | 7/1980 | Mitman et al. | 83/32 |
| 4,613,321 | 9/1986 | Kesten et al. | 493/342 |
| 4,798,116 | 1/1989 | Silver et al. | 83/858 |
| 4,932,915 | 6/1990 | Boris et al. | 446/75 |
| 5,015,211 | 5/1991 | Reveen | 446/475 |
| 5,199,745 | 4/1993 | Balsamo | 283/117 |
| 5,295,633 | 3/1994 | Kimbro et al. | 241/166 |
| 5,352,148 | 10/1994 | Watkins | 445/475 |
| 5,354,227 | 10/1994 | Watkins | 446/475 |
| 5,388,490 | 2/1995 | Buck | 83/880 |
| 5,403,225 | 4/1995 | Watkins | 446/475 |
| 5,419,731 | 5/1995 | Watkins | 446/475 |
| 5,487,706 | 1/1996 | Wilk | 472/54 |
| 5,495,671 | 3/1996 | Shun-Yi | 30/364 |
| 5,507,680 | 4/1996 | Watkins | 446/475 |
| 5,601,472 * | 2/1997 | Parker | 446/475 |
| 5,620,354 | 4/1997 | Watkins | 446/475 |
| 5,643,042 | 7/1997 | Watkins | 446/475 |
| 5,797,304 | 8/1998 | Sterr et al. | 83/27 |
| 5,911,805 | 6/1998 | Sterr et al. | 83/27 |
| 5,954,563 * | 9/1999 | Spriggs | 446/475 |
| 6,027,773 * | 2/2000 | Sterr et al. | 428/7 |

* cited by examiner

*Primary Examiner*—John A. Ricci
(74) *Attorney, Agent, or Firm*—Lyon & Lyon LLP

(57) ABSTRACT

A durable and desirable foam specialty confetti. A die cutting process may be employed to create a perimeter, exterior cut out on a sheet of foam. The resulting specialty confetti can be ejected into the air numerous times for multiple enjoyment or be collected as a keepsake.

6 Claims, 9 Drawing Sheets

KEEPSAKE CONFETTI

BACKGROUND OF THE INVENTION

The field of the present invention is specialty confetti.

Confetti has traditionally been created from scrap paper such as small round circles from the manufacture of spiral or three-hole punch notebooks or other waste material. Confetti may also be made quickly in large quantities by a method of cutting several sheets of tissue paper with a straight edge cutter. Confetti having a specific design has been made by a method of die cutting sheets of tissue paper as disclosed in U.S. Pat. No. 5,911,805 issued to Sterr, et al., which is hereby incorporated by reference as if fully set forth herein.

The disadvantages of traditional confetti and its method of manufacture are numerous. First, the use of paper scraps such as circles or irregular shapes limit design variations. As scraps are not intended to be confetti, they are typically either a standard geometric shape (circle, square, rectangle, etc.) or a completely irregular unidentifiable shape. Second, as paper or tissue scraps are not the intended product, the confetti must be collected from the waste of the manufacture of other goods. Such a method of manufacture is time consuming and inefficient for rapid mass production of a specific design of confetti. Third, as traditional confetti is made from paper or tissue, once wet, the confetti may clump and become difficult to pick up. Wet tissue paper confetti can also clog drainage systems. Fourth, once paper tissue confetti is tossed and settles to the ground, the confetti's utility extinguishes and is transformed to refuse. Therefore, the useful life of confetti is short.

Confetti manufactured by the use of a straight edge paper cutter reduces the amount of effort involved in collecting and packaging confetti compared to creating confetti made from waste scraps. However, the use of a straight edge paper cutter limits the shapes of the various possible confetti designs to geometric shapes composed of straight lines such as triangles, rectangles, squares and other tetragonal shapes.

Tissue paper confetti manufactured using a die can produce designs having straight lines and/or curves, and therefore increases possible confetti design options available compared to using the straight edge paper cutter method. However, close ended die cutting on tissue paper results in individual pieces of confetti fusing or sticking to each other. Although the amount of fusing is substantially reduced using an open ended die as compared to a close ended die, the use of an open ended die still requires an operator to burst or fluff the edges of a confetti stack after the die cutting operation to separate each piece of confetti. Additionally, the severity of fusing increases where the confetti design has a sharp point or an abrupt change in the profile with a small fillet or outside radius. Therefore, to maximize efficiency and minimize bursting of confetti stacks, design options for die cutting tissue paper are often limited to designs having gradual changes in the profile contour or large fillet or outside radius and lack sharp points along the design profile.

SUMMARY OF THE INVENTION

The present invention is directed to an improved form of specialty confetti. To this end, a cutting process on a sheet or stack of foam is employed for creating confetti. Accordingly, it is an object of the present invention to provide a confetti that is durable and enables reuse. Another object of the present invention is to extend the desirability of the confetti even after it has been discharged into the air and has settled to the ground. Other and further objects and advantages will appear hereinafter.

DETAILED DESCRIPTION OF THE PREFERRED EMBODIMENTS

Figure 4:
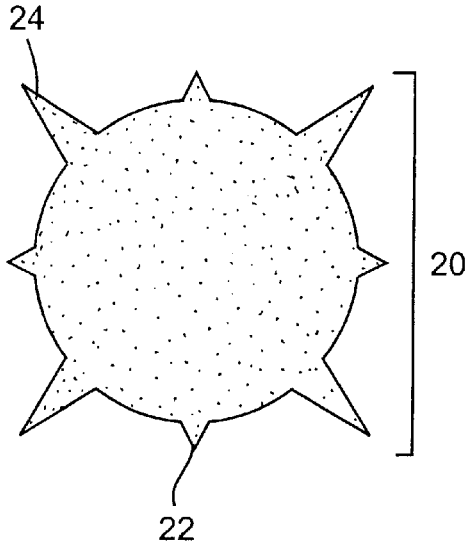
FIG. 4 shows a top view of a multi-point confetti design unfavorable for tissue paper confetti.

With reference now to the drawings in which like reference numerals arc used for like or similar parts throughout the several views, there is shown in FIG. 4 a view of one embodiment of a foam confetti in accordance with the present invention.

Figure 1:
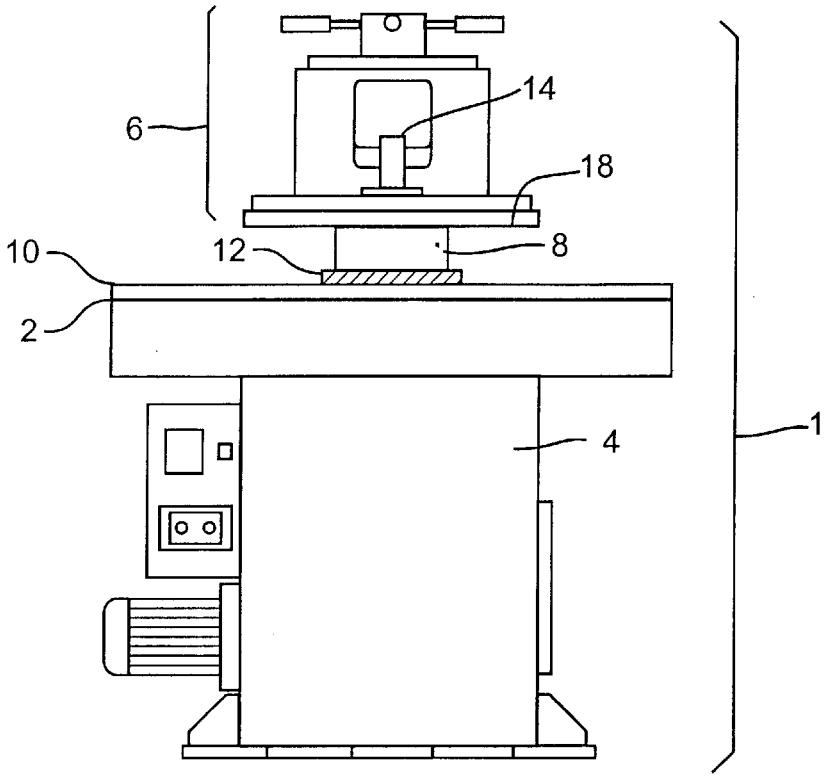
FIG. 1 shows a front view of a press for practicing a method of die cut confetti.
Figure 2:
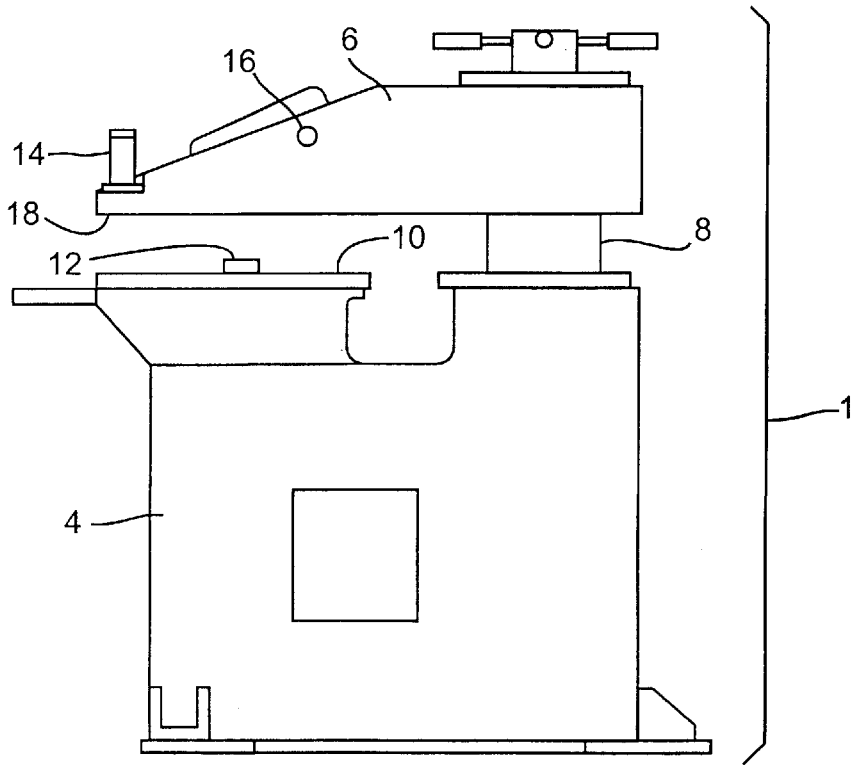
FIG. 2 shows a side view of a press for practicing a method of die cut confetti.

FIG. 1 shows a front view of a swing arm cutting press, model 19, manufactured by Meccanica ALLEVI Vigevano s.p.a. FIG. 2 shows a corresponding side view of the same machine. Cutting press 1 is an example of the type of cutting press used in the manufacture of die cut confetti that may be applied in the production of the preferred embodiments. Those skilled in the art will recognize that other die cut machines can be used to practice the preferred embodiments discussed herein.

Cutting press 1 has a flat horizontal working area 2 supported by base 4 and a moveable head 6 attached to the base 4 by arm 8. Cutting press 1 is a standard hydraulic press that is well known to those skilled in the art and is adjustable so that various amounts of force can be applied to various types and amounts of material.

Confetti may be made from foam of varying thickness and density. The preferred embodiment utilizes foam with a density of 0.097 g/cm$^3$. However, foam with a density of 0.05–1.0 g/cm$^3$ and a thickness of 0.030 to 0.079 inch (1–2 mm) may be utilized. As is well known in the art, foam may be made from a variety of processes. The preferred embodiment is not limited to a particular type or manufacture of foam. Natural or synthetic foam rubber may be utilized. In addition synthetic foams including but not limited to: polyurethane foam; butadiene-styrene foam; polystyrene foam; latex foam; and silicone foam may be utilized for the invention. The silicone foams are particularly apt for flame-resistant, water-resistant confetti. Confetti can be made with treated or untreated foam sheets. Treated foam sheets make the confetti flame-resistant and water resistant-increasing the safety of the confetti near ignition sources and aiding clean up. A preferred embodiment is made from colored foam sheets, such as Foamies™ Fun Brightly Colored Foam Sheets by Darice Inc., of Strongville, Ohio.

Figure 3:
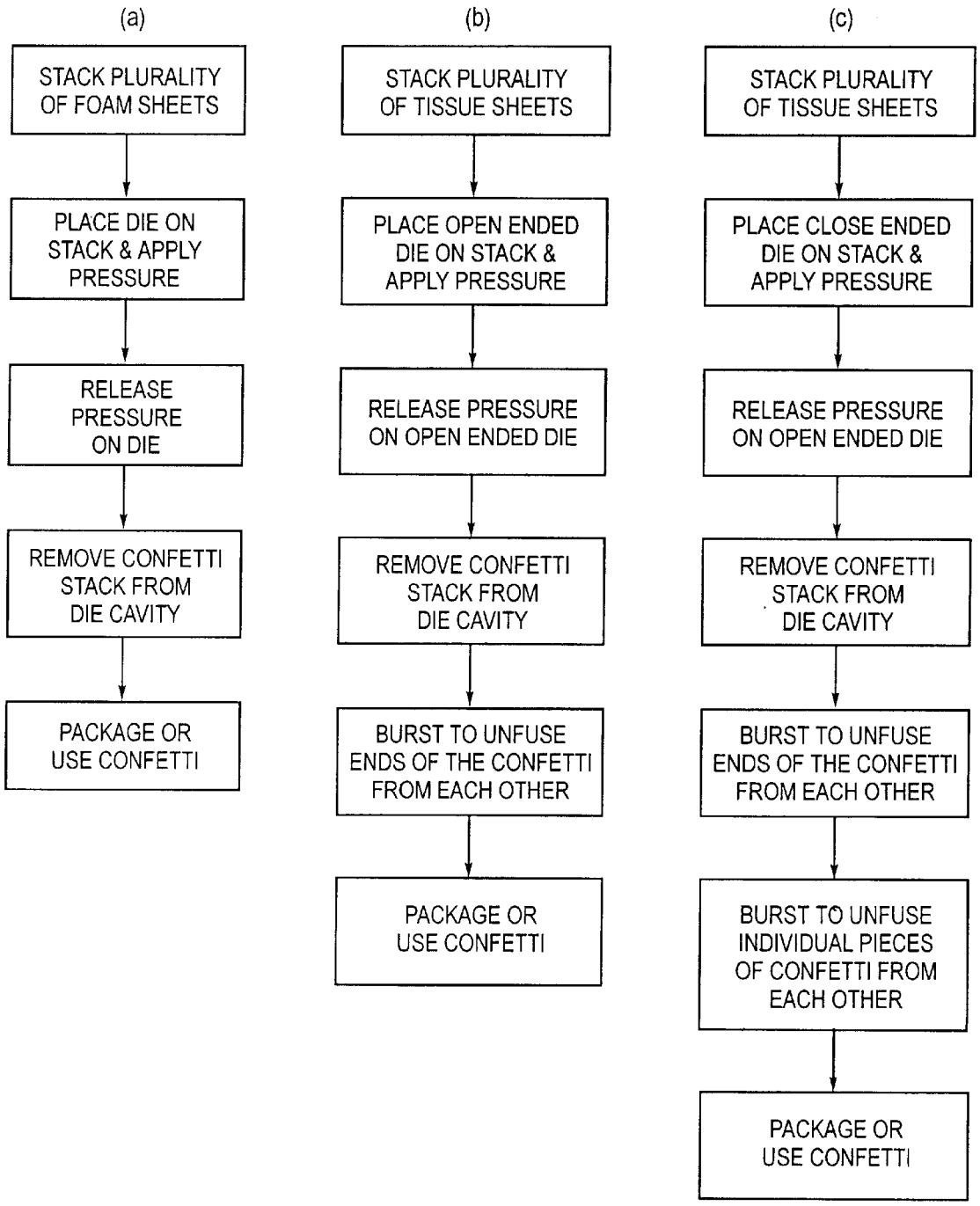
FIG. 3 shows flow diagrams of manufacturing process for foam confetti and tissue confetti using open and close ended die.

Turning now to the manufacturing process, FIG. 3*a* shows a flow chart of the process to produce the present invention; FIG. 3*b* shows a flow chart of the process to produce tissue paper confetti using an open ended die; and FIG. 3*c* shows a flow chart of the process to produce tissue paper confetti using a close ended die. As shown in FIG. 1, a stack 10 of pre-cut foam sheets of about twelve by eighteen inches is placed on working area 2. If using a rolled stock of foam sheet, cut sheets of about twenty inches by thirty inches may be used to make stack 10. Stack 10 of foam sheets may be one sixteenth to one inch thick (about 1 to 25 sheets). However, stack 10 of one half to five eighths inch thick is preferred for a five to six cavity gang die. Although, as few as one sheet of foam sheet can be cut by the disclosed method, for mass production of confetti, single sheet cutting is inefficient.

Next, the hydraulic cutting press 1 in FIGS. 1 and 2 is set to apply sufficient amount of force to a die or gang die 12 which has been placed on top of foam sheet stack 10. The hydraulic cutting press 1 is activated by simultaneously pushing center button 14 and one of the two side buttons 16 which actuates the hydraulic press so that the hydraulic press head 6 is lowered towards the die 12 and foam sheet stack 10. As the hydraulic press head 6 lowers, plate 18 of head 6 pushes down on die 12 causing die 12 to cut foam sheet stack 10 into confetti of the desired size and shape. The hydraulic press head 6 then raises up to allow the user to remove die 12 and collect a stack of confetti. The confetti stack can then be removed from the working area 2 for packaging or the process can be repeated without removing the confetti from the die cavity to create a thicker stack of cut confetti. This process can be repeated until all the available space of the stack 10 of foam sheets has been cut. Preferably, between uses a lubricant, such as silicone, may be sprayed onto the die to enhance easy removal of the cut foam confetti.

Advantageously, foam confetti is ready to be packaged or used for entertainment purposes immediately after the die cutting operation as shown in FIG. 3*a*. In contrast, edge portions of a stack of tissue paper confetti may fuse during the die cutting operation and require a bursting step to separate every piece of tissue paper confetti from every other piece of confetti. Production of tissue paper confetti using a close ended die results in fusing between the layers of sheets of tissue and the edges of the confetti. The time intensive and laborious process of bursting close ended die confetti often results in tearing or damaging the confetti. Using an open ended die limits fusing to the edges or the perimeter of the exterior cutout. In either case, die cutting on tissue paper confetti typically requires a bursting operation before the tissue paper confetti is usable.

On the other hand, foam confetti production does not require bursting because it does not fuse during the die cutting process. Therefore, the foam confetti manufacturing process does not require a bursting step to separate individual pieces of confetti from each other. Additionally, the reduction of steps in the production process inherently reduces the likelihood of damage due to reduced handling. Furthermore, either open or close ended die may be used for foam confetti production because fusing does not occur. Hence, advantageously, using foam sheets to produce confetti reduces the number of operations necessary to yield usable confetti, reduces the potential for damage during production, and does not limit tools or dies that may be utilized for production.

The design options available for foam confetti is broad. Any of the shapes and designs disclosed in U.S. Pat. No. 5,797,304 issued to Sterr, et al., which is hereby incorporated by reference as if fully set forth herein, may be used for the production of the preferred embodiments. Additionally, the various die cut designs having an exterior and interior shapes as disclosed in U.S. Pat. No. 5,911,805 issued to Sterr, et al., which is hereby incorporated by reference as if fully set forth herein, may be used for the production of the preferred embodiments. Also, tetragonal designs may be created using standard straight edge cutter for the production of the preferred embodiments.

Figure 7:
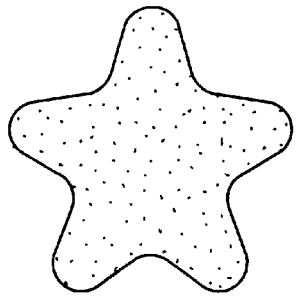
FIG. 7 shows a top view of a star shape design favorable for tissue paper confetti.
Figure 5:
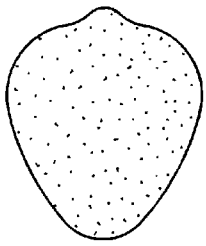
FIG. 5 shows a top view of a dogwood petal shape design favorable for tissue paper confetti.
Figure 6:
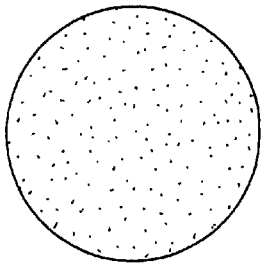
FIG. 6 shows a top view of a circle shape design favorable for tissue paper confetti.

The absence of fitting during the die cutting operation on foam sheets in contrast to tissue paper sheets increases the available design options for foam confetti. Die cutting a confetti design 20 as illustrated in FIG. 4 on tissue paper results in severe fusing at sharp points which will require extensive time and effort to burst. A sharp point in a confetti design is an abrupt change in the contour of the shape with a fillet radius 22 or outside radius 24 of about 0.100 inch or less. Die cutting using open or close ended die on tissue paper a design having sharp points 22 or 24 as shown in FIG. 4 will often produce stacks of confetti that cannot be unfused without destroying the confetti. Therefore, design options on a tissue confetti is limited to those having generous rounded comers such as an acorn shape, circle shape or a star shape as illustrated in FIGS. 5, 6 and 7, respectively.

Figure 8:
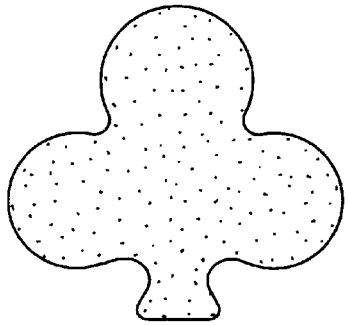
FIG. 8 shows a top view of a clover design.
Figure 9:
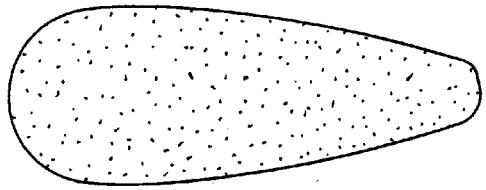
FIG. 9 shows a top view of an ellipse design.
Figure 10:
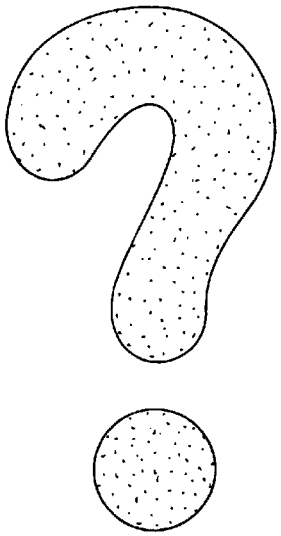
FIG. 10 shows a top view of a question mark design.
Figure 13:
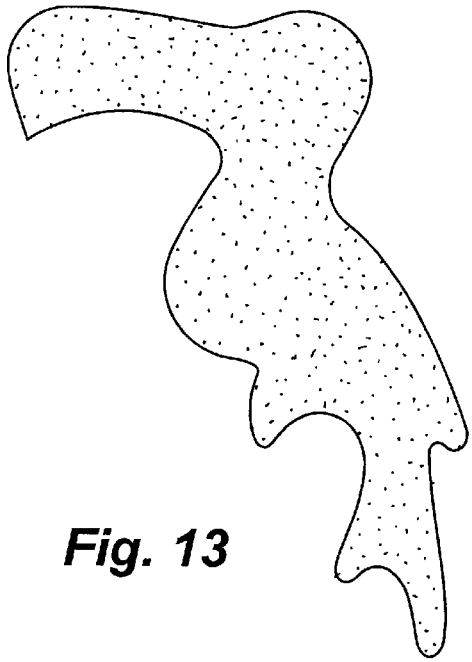
FIG. 13 shows a top view of a toucan bird design.
Figure 11:
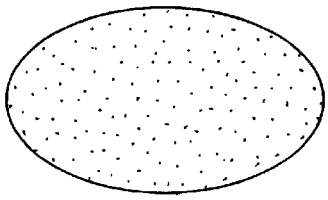
FIG. 11 shows a top view of an oval design.
Figure 14:
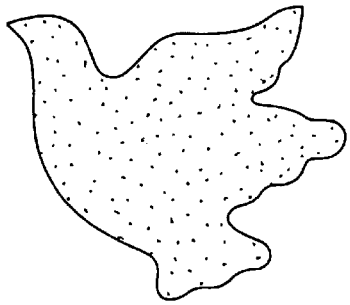
FIG. 14 shows a top view of a dove bird design.
Figure 12:
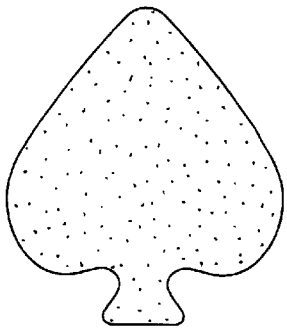
FIG. 12 shows a top view of a spade design.
Figure 15:
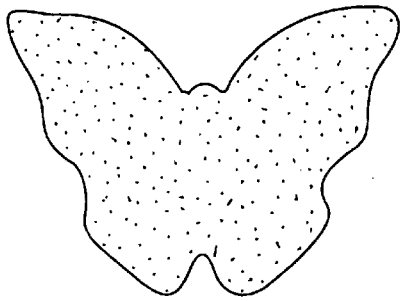
FIG. 15 shows a top view of a butterfly design.
Figure 16:
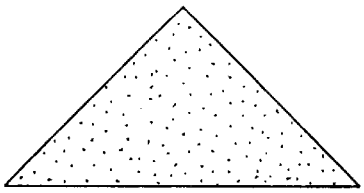
FIG. 16 shows a top view of a triangle design.
Figure 17:
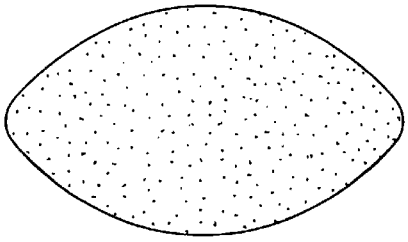
FIG. 17 shows a top view of a football design.
Figure 18:
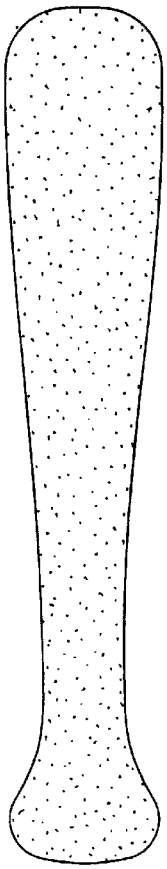
FIG. 18 shows a top view of a baseball bat design.
Figure 19:
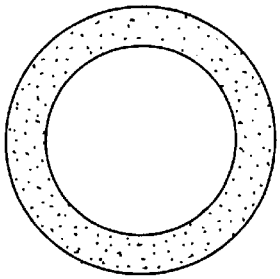
FIG. 19 shows a top view of a ring design.
Figure 20:
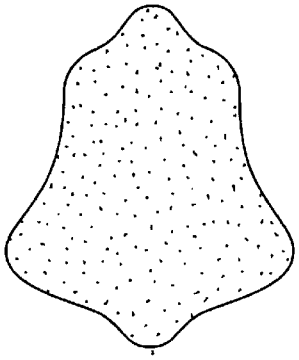
FIG. 20 shows a top view of a bell design.
Figure 21:
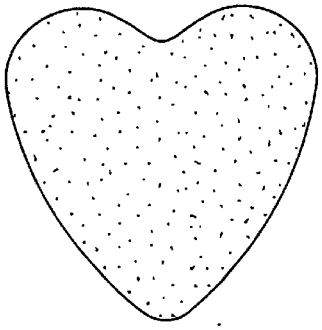
FIG. 21 shows a top view of a heart design.
Figure 22:
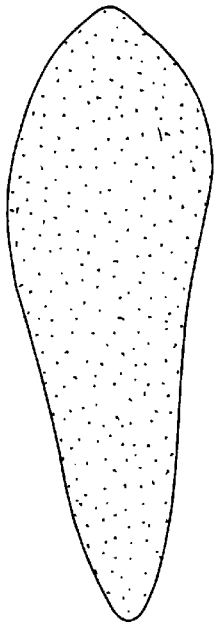
FIG. 22 shows a top view of a willow leaf design.
Figure 23:
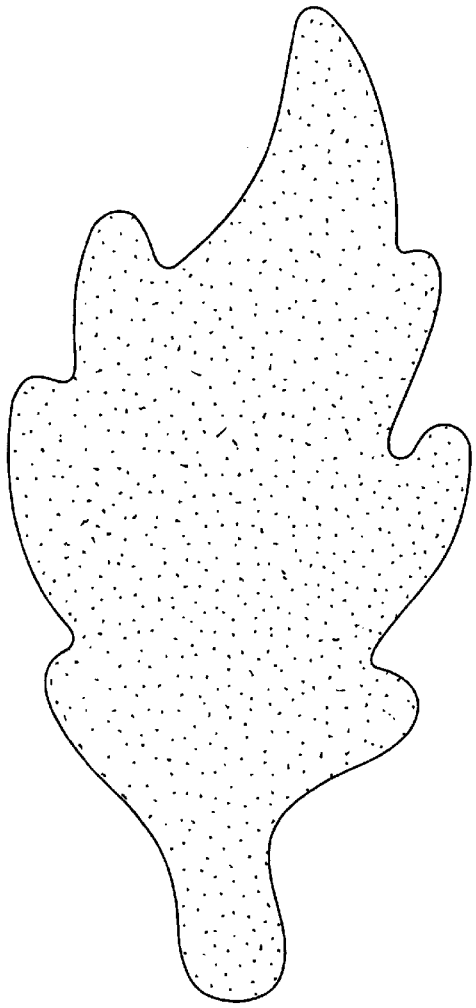
FIG. 23 shows a top view of an oak leaf design.
Figure 24:
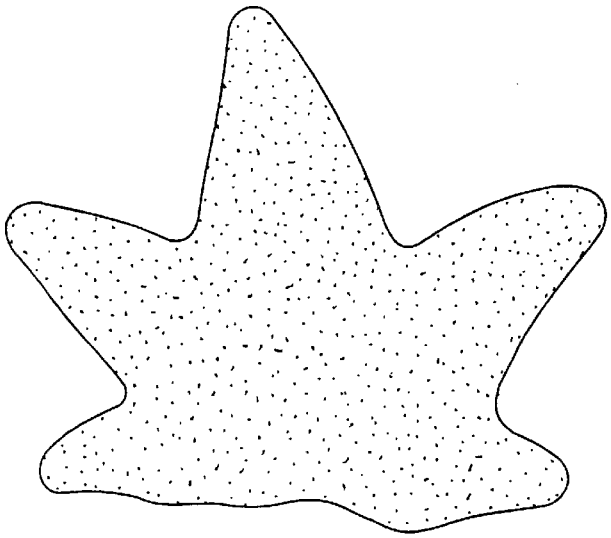
FIG. 24 shows a top view of a sycamore leaf design.

By contrast, designs for foam confetti is not so restricted. Hence, design options available for foam confetti may include straight lines, curves, sharp or wide angles, small or large radius, or any combination thereof. Some design options available for foam confetti are shown in: FIG. 4 illustrating top view of a multi-point design; FIG. 5 illustrating a view of a dogwood petal design; FIG. 6 illustrating a top view of a circle design; FIG. 7 illustrating a top view of a star design; FIG. 8 illustrating top view of a clover design; FIG. 9 illustrating top of an ellipse design; FIG. 10 illustrating top view of a question mark design; FIG. 11 illustrating top view of an oval design; FIG. 12 illustrating top view of a spade design; FIG. 13 illustrating top view of a toucan bird design; FIG. 14 illustrating a top view of a dove bird design; FIG. 15 illustrating top view of a butterfly design; FIG. 16 illustrating top view of a triangle design; FIG. 17 illustrating top view of a football design; FIG. 18 illustrating top view of a baseball bat design; FIG. 19 illustrating top view of a ring design; FIG. 20 illustrating a top view of a bell design; FIG. 21 illustrating a top view of a heart design; FIG. 22 illustrating a top view of a willow leaf design; FIG. 23 illustrating a top view of an oak leaf design; and FIG. 24 illustrating a top view of a sycamore leaf design.

Figure 25:
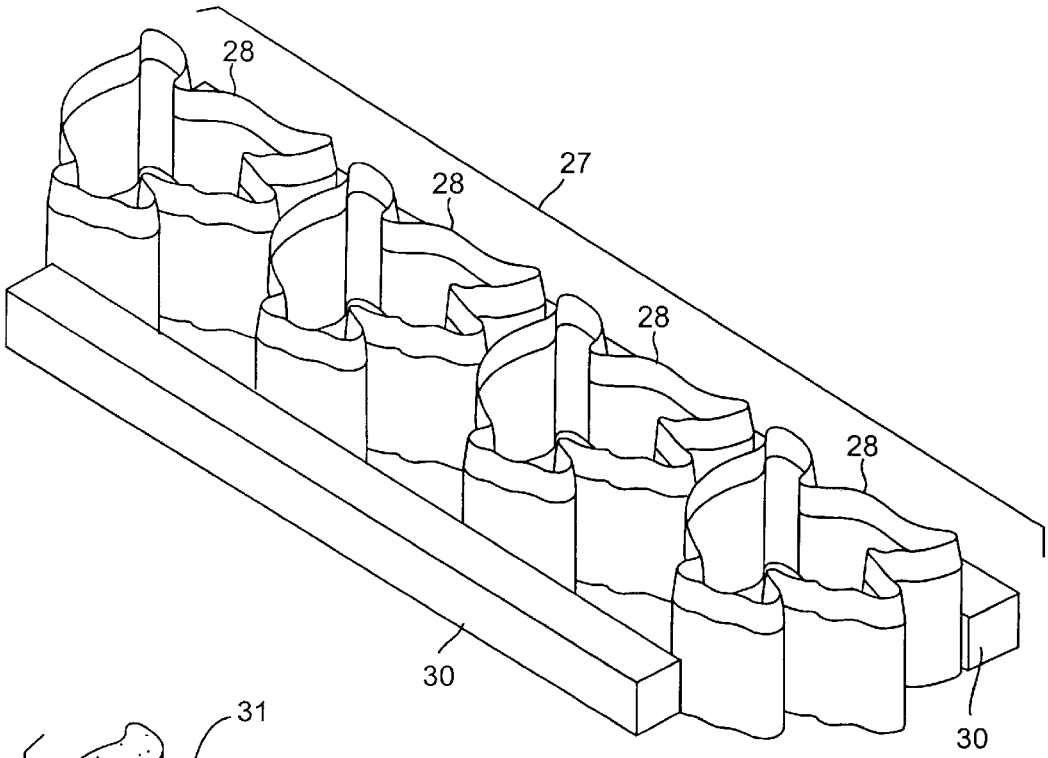
FIG. 25 shows a perspective view of a gang die for forming confetti having a bird design.

FIG. 25 shows a perspective view of a gang die 27 that may be used for forming a bird shaped confetti. As shown in FIG. 25, individual dies 28 are welded onto metal bars 30 which hold the gang die together. Advantageously, for foam confetti production, either open or close ended die may be used because of the absence or fusing between individual foam confetti pieces. Preferably, an open ended die is used for the production of the present embodiment because it provides greater access for confetti stack removal. Additionally, open ended die provides visual confirmation of proper die 28 placement over the foam sheet stack 10 during the cutting operation.

Preferably, the dies used are forged clearance dies with a high polished finish and an extended cutting edge. The forged clearance dies have a blade height of one and one-quarter inches and cutting edge height of approximately one eighth of an inch. As those skilled in the art of die cutting will readily recognize, the cavity of the forged clearance die widens along the height of the blade. Alternatively, flexible steel dies with a waxed finish can be used. The flexible steel die has a cavity of about one and one-quarter inches in height and a cutting edge height of about one-sixteenth inch. Additionally, for either type of die, breakaway chisel arms may be used to release pressure and allow thicker stacks of foam to be cut. It is also preferred to have pressure relief notches cut out of the top edge of the die to allow air to escape as the confetti fills the die cavity.

Figure 26:
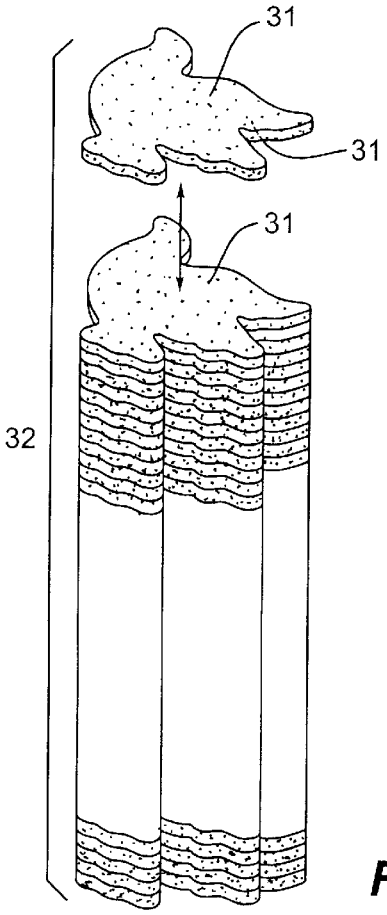
FIG. 26 shows a perspective view of a foam confetti stack.

Each die cut foam confetti has two faces 31 as shown in FIG. 26. Preferably, several hundred pieces of the foam confetti is stacked together in a face-to-face relationship to each other to form an accumulation of confetti or foam confetti stack 32 as shown in FIG. 26. Preferably, each foam confetti stack 32 has individual pieces of confetti substantially aligned to each other to form a column of confetti. Preferably, the foam confetti stack 32 is inserted into a confetti cannon to be launched into the air. Alternatively, the confetti stack 32 may be tossed by hand.

Figure 27:
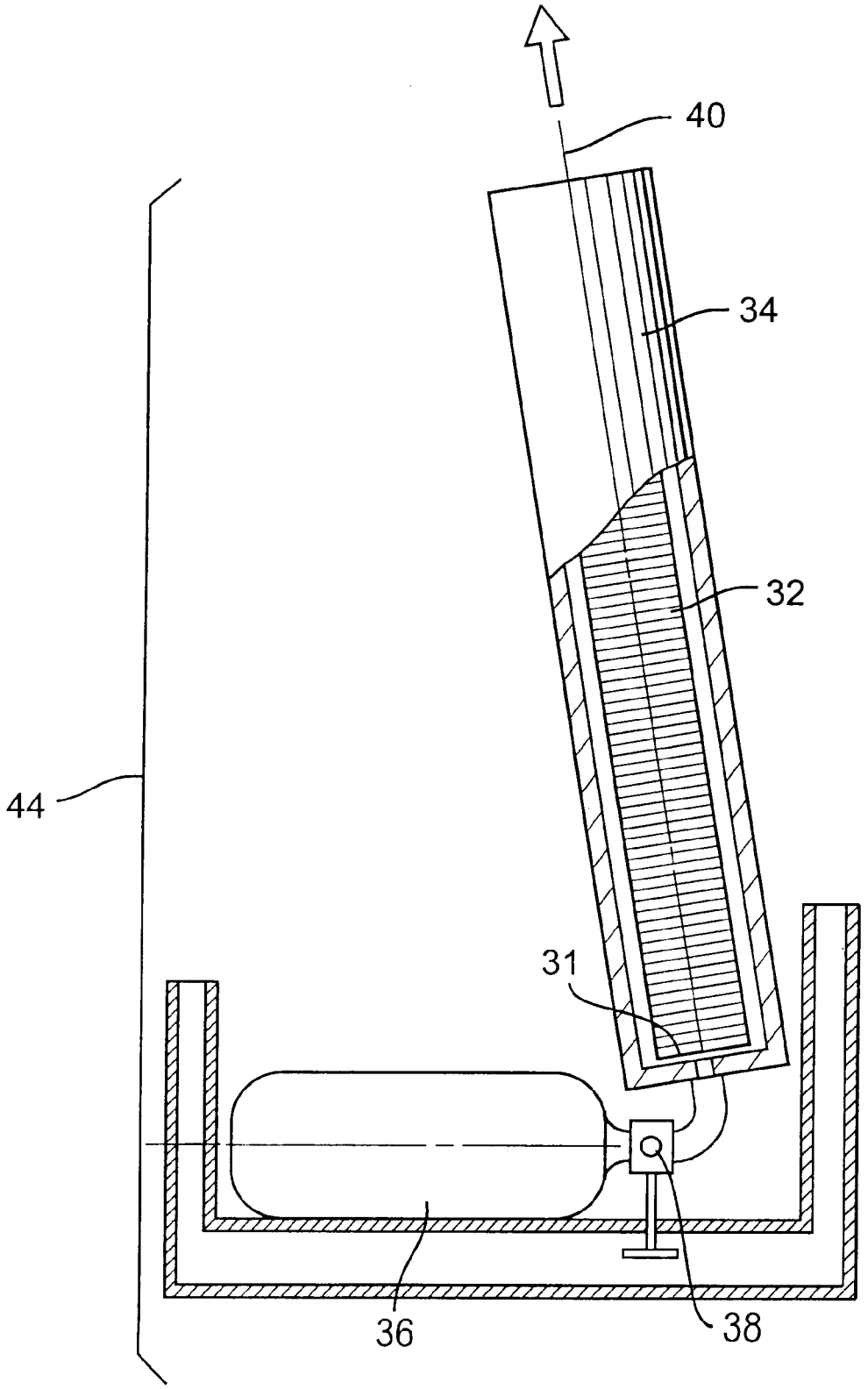
FIG. 27 shows a sectional view of a confetti cannon, with a cutaway of the tube showing a foam confetti stack positioned in the tube prior to discharge.

Referring to FIG. 27, an elongated hollow tube 34 is shown having a relatively smooth interior surface typical of a commercial confetti propulsion device or cannon such as Big Shots® Cannon or Big Blaster Cannon by Artistry In Motion Entertainment Inc., of Van Nuys, Calif. Generally, a confetti cannon includes a hollow tube 34 to hold the confetti to be discharged; a propulsion means 36 such as a $CO_2$ source associated to the hollow tube 34; and a means to actuate the propulsion means such as a valve device 38 mounted between the hollow tube 34 and propulsion means 36 to release pressure to discharge the confetti. In operation, the valve device 38 is actuated to release the compressed gas which acts on an accumulation of confetti to launch the confetti held in the hollow tube 34 into the air.

A wide range of length and diameter combination may be used on tube 34. However, the length is preferably about twenty to forty inches to hold a substantial amount of confetti. Also, the inner diameter of tube 34 is preferably two to eight inches to accommodate various sizes and amounts of confetti to launch. As shown in FIG. 27, to subject the confetti stack 32 to maximum force for ejection out of the confetti cannon, it is preferable to position the foam confetti face 31 substantially orthogonal to the direction of the projection. Maximum ejection force on the foam confetti is achieved by exposing the greatest confetti surface area orthogonal to the direction of the projection, which is generally parallel to the centerline axis 40 of the tube 34.

Figure 29:
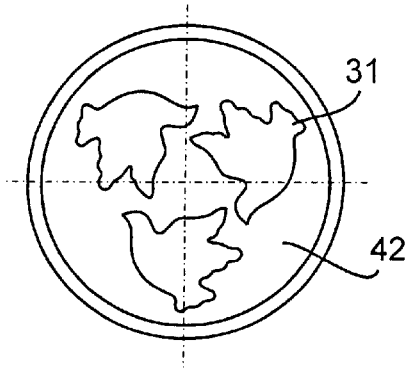
FIG. 29 shows a top view of a confetti cannon showing multiple stacks of foam confetti.
Figure 28:
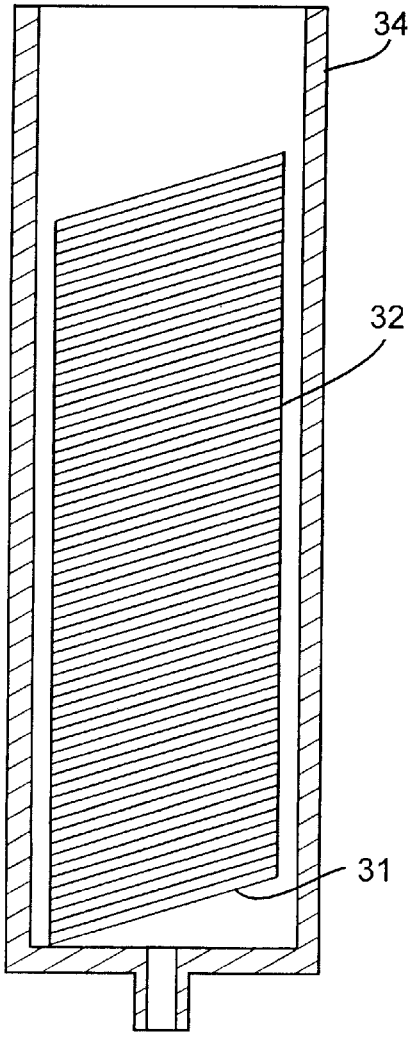
FIG. 28 shows a sectional view of the tube of a confetti cannon showing the accumulation of confetti positioned in the tube prior to discharge, where the length of the confetti is greater than the inner diameter of the tube.
Figure 30:
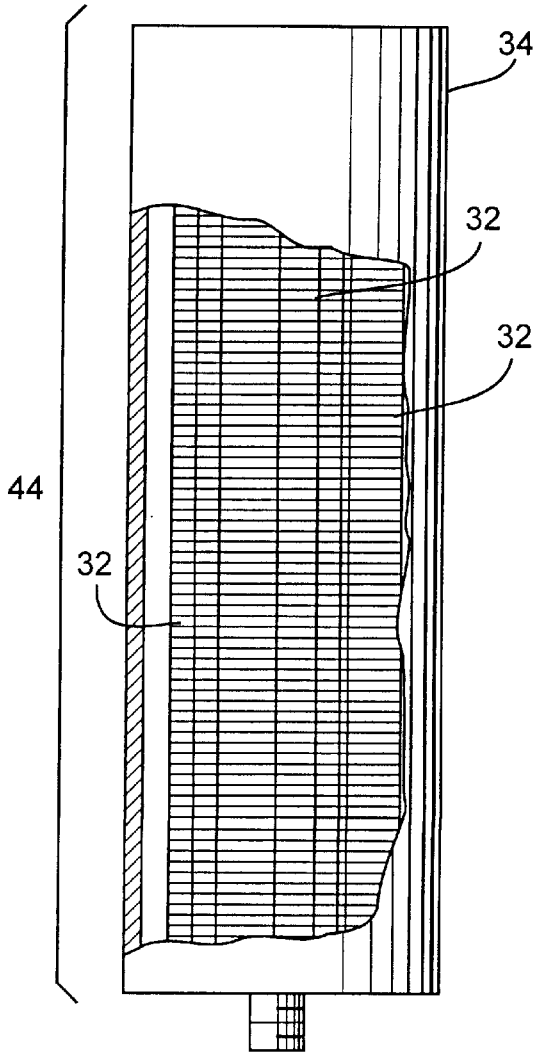
FIG. 30 shows a sectional view of the tube of a confetti cannon showing multiple stacks of foam confetti.

In situations where the confetti length is greater than the inside diameter of the tube, it is preferable to position the accumulation of confetti in such a way as to maximize the cross sectional area exposed to the discharge pressure as shown in FIG. 28. In situations where the surface area of the face 31 is smaller than the available cross sectional area 42 of the tube 34, multiple columns of confetti stack 32 may be loaded into the propulsion device 44 as shown in FIGS. 29 and 30. Advantageously, each foam confetti stack 32 retains its columnar alignment as numerous confetti stacks 32 are inserted into a cannon to maximize the amount of confetti that can be loaded into the available space in the hollow tube 34 of the cannon. Tissue paper confetti, on the other hand, has substantially no weight and therefore does not easily retain its stack or columnar alignment. As tissue paper confetti stacks are loaded into the confetti cannon, they tend to topple and thereby occupy more space. Therefore, foam confetti permits a greater number of stacks to be uniformly loaded into the confetti cannon to fill the cannon space more efficiently.

In use, the specialty confetti can be launched into the air using a propulsion device, such as confetti cannon 44, or tossed by hand. The foam confetti is preferably heavier than traditional paper or tissue confetti and therefore has a noticeably distinct flight pattern. Generally, the foam confetti has a tumbling or free-falling effect and its path of descent is primarily vertical. When the foam confetti lands on a patron, unlike tissue paper confetti that essentially has no weight or thickness, the patron senses the pleasing touch of the foam confetti. Traditional paper confetti of comparable weight may injure patrons because of its rigidity. This is especially a concern if heavy paper confetti was to strike the patron in the face. Therefore, foam confetti safely provides a visual and tactile experience that is unique from traditional tissue paper confetti.

In addition to providing a festive mood, for example at a party or a public event, the unique experience created by the present invention triggers a curiosity among the patrons to investigate the descending confetti. The result is a desire by the patrons to retain the foam confetti as a memento of the accompanying event or as a keepsake for their continued enjoyment. Unlike traditional confetti, which is transformed into refuse once its flight ends, foam confetti becomes an item sought to be collected. A logo or message may be imprinted on the surface of the foam confetti to commemorate the event, or otherwise enhance the unique confetti experience.

Advantageously, patrons retaining the foam confetti may reduce the burden for cleanup. Moreover, as the confetti is made of foam, that which remains is easier to cleanup than traditional confetti. Unlike traditional tissue or paper confetti which is difficult to pick up because it sticks to the ground or clump up when wet, the durable foam confetti of the preferred embodiments resists water and is therefore easier to pickup. Thus, sweeping or vacuuming may easily collect any confetti, constructed according to the preferred embodiments, which are not picked up by the patrons.

Furthermore, the specialty confetti disclosed herein according to the preferred embodiments can be reused or re-ejected after initial use. The discharged foam confetti may be collected and be directly inserted into a confetti cannon for re-ejection. However, it is preferred that the specialty confetti be re-stacked prior to re-ejection into the air to permit a greater number of foam confetti to be efficiently ejected into the air. Alternatively, the used foam confetti may be hand tossed into the air.

Thus, specialty confetti is disclosed which employs a cutout process on a foam sheet. While embodiments and applications of this invention have been shown and described, it would be apparent to those skilled in the art that many more modifications are possible without departing from the inventive concepts herein. The foregoing description, therefore, should be taken as illustrative and not limiting in any sense.

What is claimed is:

1. A method of using foam confetti comprising the steps of:

accumulating a plurality of individual pieces of foam confetti for discharging into the air;

discharging the plurality of individual pieces of foam confetti;

collecting said discharged individual pieces of foam confetti; and re-accumulating said collected individual pieces of foam confetti for re-discharging into the air.

2. The method of claim 1 wherein the step of accumulating a plurality of individual pieces of confetti comprises stacking the plurality of individual pieces of confetti in a face-to-face relationship.

3. A method of launching foam confetti into the air comprising:

accumulating a plurality of individual pieces of foam confetti to be discharged;

inserting the accumulation of individual pieces of foam confetti into a hollow tube of a confetti propulsion device; and activating the confetti propulsion device to launch the accumulation of individual pieces of foam confetti into the air.

4. The method of claim 3 wherein the step of inserting the accumulation of individual pieces of confetti includes positioning the face of individual pieces of confetti orthogonal to the centerline axis of the hollow tube.

5. The method of claim 4 wherein the step of accumulating a plurality of individual pieces of foam confetti includes stacking the plurality of foam confetti in a face-to-face relationship.

6. The method of claim 5 wherein the step of inserting the accumulation of individual pieces of confetti includes inserting a plurality of stacks of confetti.

* * * * *